United States Patent [19]

Kashiwaba

[11] Patent Number: 5,064,300

[45] Date of Patent: Nov. 12, 1991

[54] THERMAL PRICE TAG PRINTER THERMAL HEAD SUPPORT STRUCTURE

[75] Inventor: Tadao Kashiwaba, Iwate, Japan

[73] Assignee: Kabushiki Kaisha Sato, Japan

[21] Appl. No.: 363,959

[22] Filed: Jun. 8, 1989

[30] Foreign Application Priority Data

Jun. 9, 1988 [JP] Japan ..... 63-142525

[51] Int. Cl.[5] ..... B41J 11/20

[52] U.S. Cl. ..... 400/56; 400/120

[58] Field of Search ..... 400/120 R, 120 HE, 56

[56] References Cited

U.S. PATENT DOCUMENTS 4,439,777 3/1984 Aprato ..... 400/56
4,949,098 8/1990 Gluck et al. ..... 400/56

FOREIGN PATENT DOCUMENTS 3417381 11/1985 Fed. Rep. of Germany ..... 400/56
0148676 9/1982 Japan ..... 400/56
0094370 4/1987 Japan ..... 400/120 HE
0174176 7/1987 Japan ..... 400/120 HE
0092465 4/1988 Japan ..... 400/120 HE

*Primary Examiner*—Eugene H. Eickholt
*Attorney, Agent, or Firm*—Ostrolenk, Faber, Gerb & Soffen

[57] ABSTRACT

In a thermal printer having a platen and thermal print head, the print head is supported on a special print head support structure which allows the print head to pivot so as to apply a uniform pressure across the width of labels or price tags which are fed between the print head and the platen. The support structure for the print head includes: a two-part support member including a print head attachment member for holding the thermal print head and a pressing member for pressing the thermal print head toward the platen; a fixed spindle for rotatably supporting the support member; and a pivot member between the thermal print head attachment member and the spindle, the pivot member enabling the attachment member, and therefore the print head, to pivot in a plane parallel to the axis of the platen in a manner which tends to equalize the pressure across the labels or price tags being imprinted.

22 Claims, 10 Drawing Sheets

THERMAL PRICE TAG PRINTER THERMAL HEAD SUPPORT STRUCTURE

BACKGROUND OF THE INVENTION

The present invention relates to printers which are used to print information on price tags or labels, and more particularly to a support structure which is able to maintain a thermal print head within the printer so that the print head will apply an optimum and uniform printing pressure to labels, in a manner which is insensitive to the width of the labels or to variations in the nature of the contact which develops between the labels and the thermal print head as the labels are being fed.

FIG. 10 shows a typical price tag strip 1. It consists of a strip of backing sheet 2 coated on its front surface with a separating agent and a plurality of labels 3 detachably adhered continuously along the length of the backing sheet 2. The labels 3 are coated with a pressure-sensitive adhesive. However, some labels or tags do not use pressure-sensitive adhesive. Positioning marks 4 appear on the rear surface of the backing sheet 2. In the familiar manner, the labels 3 are printed with data related to the products on which they are usually used and these labels are then adhered to those products, forming price tags or any other identifying tags.

Price tags or labels come in long, rolled up strips. A roll of labels is loaded into a printer and the labels are imprinted with appropriate information and are either paid out singly through the front of the label printer or rolled up onto a take-up roller to provide an operator with a roll of imprinted labels or price tags. At a thermal printing section in the printer, where the labels pass between a platen and a thermal print head, slight variations occur in the nature of the contact which develops between the thermal print head and the labels. The nature of the contact is dependent on the manner in which the labels are fed. In any case, the variations in contact induce undesirable variations in the printing pressure being applied to the labels by the thermal print head. The problem is present regardless of whether single or strips of labels are fed through the printer.

Labels/price tags come in different widths and the width of labels also affects how the print head contacts the labels. This further complicates the ability to maintain optimum printing pressure across labels, and therefore the printing quality.

Another problem arises from the difficulty of assembling the thermal print head and the platen of a printer so that they extend perfectly parallel to one another. This too leads to the application of an uneven pressure across the labels and therefore to uneven printing. The aforementioned problems affect both labels and price tags.

SUMMARY OF THE INVENTION

It is an object of the present invention to provide a support structure for the print head for a label and price tag printer.

It is a further object of the present invention to provide a support structure for a print head which will enable the print head to apply to labels an optimum and uniform printing pressure while the labels are being loaded into, fed through, and printed with information within the printer. Essentially, the print head support structure should be insensitive to manufacturing inaccuracies, to a slight misalignment of the thermal print head and its platen, to the width of labels, or to the manner in which the labels are fed.

Accordingly, for a printer having a thermal print head and a platen, the present invention provides a support structure for supporting the thermal print head in a manner which permits the print head to pivot freely, to automatically compensate for the aforementioned problems. In a preferred embodiment, the support structure comprises a support member, a fixed spindle, and a pivot member. The support member includes a print head attachment member to which the thermal print head is attached and a pressing member which serves to press the thermal print head in a direction toward the platen. The entire support member is rotatably, i.e. pivotably, supported on the fixed spindle, the spindle passing through a loosely-fitting, preferably oval-shaped, channel in the attachment member.

The pivot member is disposed about midway relative to the spindle and between the attachment member and the spindle.

The orientation of the oval-shaped channel in the attachment member and the location of the pivot member are such that the attachment member is permitted to pivot, using the pivot member as a fulcrum, within a plane which is parallel to the axis of the platen. Thus, when strip-shaped price tags are fed between the thermal head and platen, even if the nature of the contact developing between the price tag strip and the thermal print head is not in its optimal state, the ability of the attachment member to pivot will constantly adjust the contact pressure along the entire width of the price tags, automatically keeping it constant and uniform. This automatic, correct pressure maintenance is obtained with wide or even narrow labels or price tags, despite the fact that in printing narrow labels only a portion of the thermal print head will come in contact with the labels.

Other features and advantages of the present invention will become apparent from the following description of the invention which refers to the accompanying drawings.

DETAILED DESCRIPTION OF THE DRAWINGS

Figure 1:
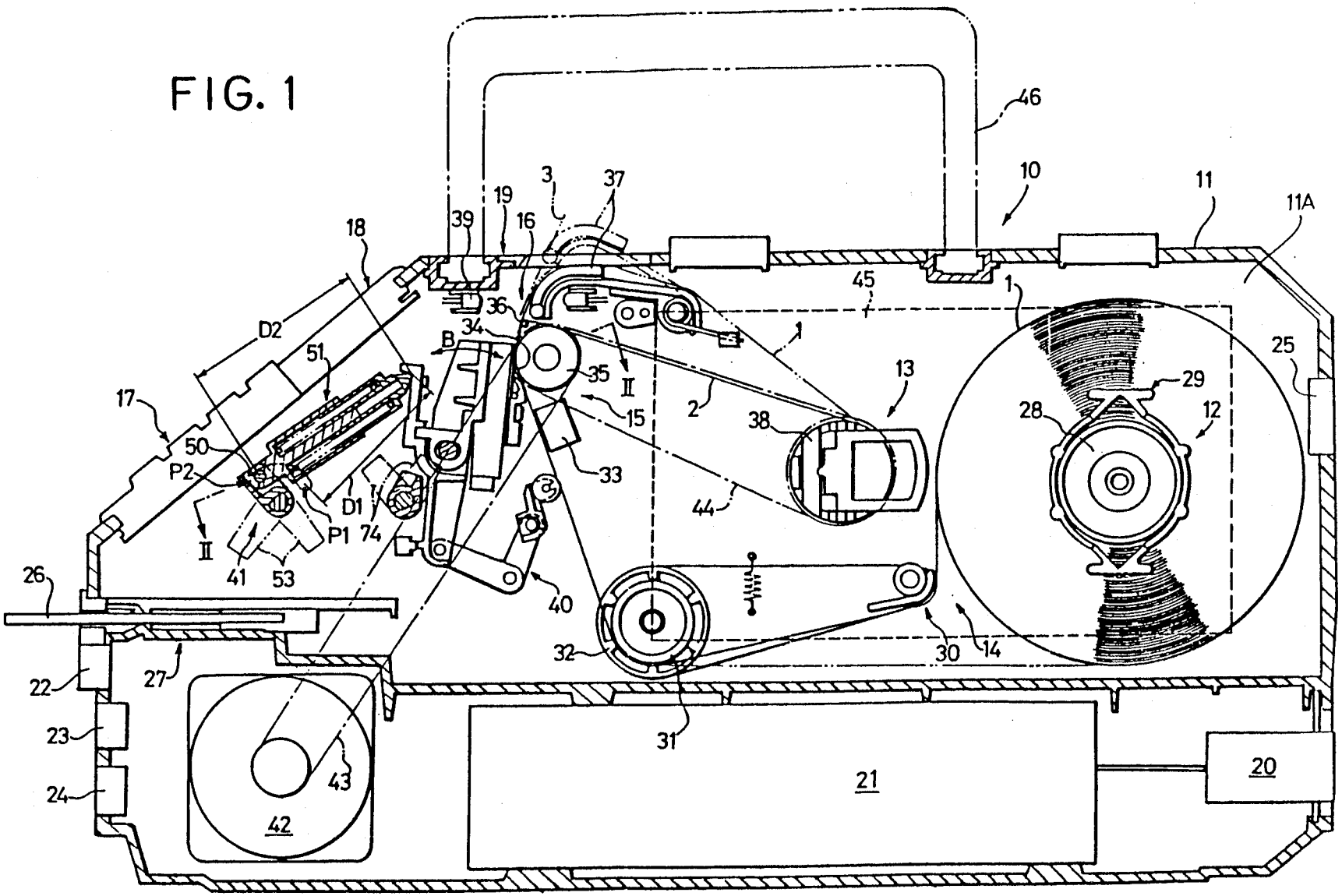
FIG. 1 is a partial side view of a portable thermal price tag printer in accordance with a preferred embodiment of the present invention.
Figure 2:
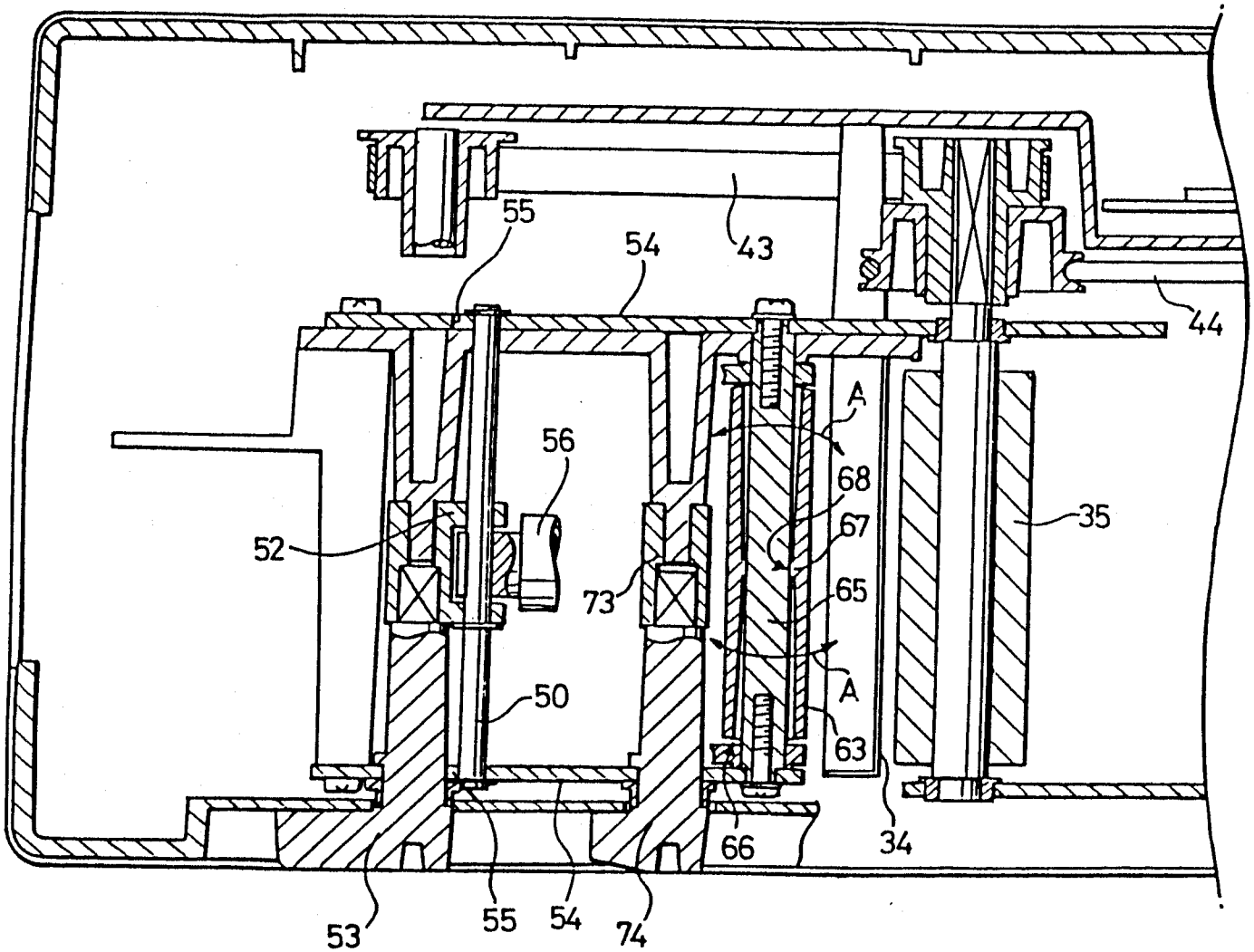
FIG. 2 is a section through line II—II in FIG. 1.
Figure 3:
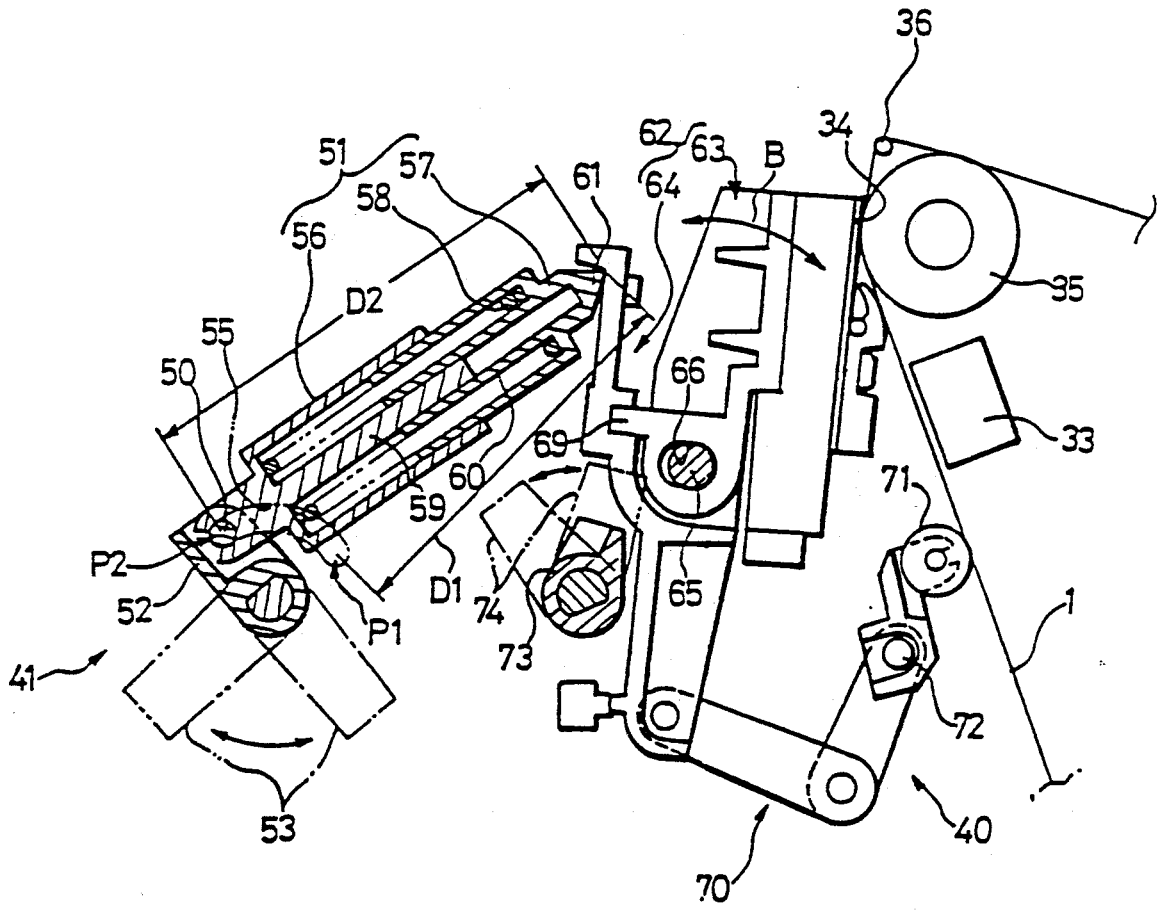
FIG. 3 is an enlarged sectional view through line II—II of FIG. 1 showing an engaging/releasing mechanism 30 for a thermal print head and a printing pressure switch mechanism 41.

A first preferred embodiment of the invention, illustrated in FIGS. 1 through 3, includes a portable thermal price tag printer 10 which is equipped with a to-be-described thermal print head support structure. This printer 10 is shown in partial crosssection with the side cover thereof removed in FIG. 1.

The printer 10 has a case 11 and, supported on a vertically extending portion 11A of the case 11, a feeder section 12 and take-up 13 for label strip 1. A passage 14 for the label strip 1 is defined between feeder section 12 and take-up section 13. More specifically, the label strip 1 travels from the feeder section 12 through a printing section 15, around a redirecting member section 16, and is then taken up by the take-up section 13.

The portable thermal price tag printer 10 further includes a data input section 17 comprising a numeric pad or function keys and a data display section 18, both disposed on the slanted front section of its case 11. A label cutting mechanism 19 of the printer 10 faces the redirecting member section 16. The printer 10 also includes a connector 20 for providing connection to a power source, a transformer 21, a power switch 22, a connector 23 for connecting to a full keyboard, a connector 24 for connecting to a pen scanner, an S-232C connector 25, and a socket 27 for installing a memory card 26 which functions as an external memory medium.

The label strip 1, in roll form, is installed on a feeder spindle 28 in the feeder section 12 and is secured against moving sideways by a label presser 29. As it leaves the feeder section 12, the label strip 1 is fed first around a guide section 30 and is then guided by a label guide spindle 31 and a label width control member 32. The position of labels 3 relative to the print head 34 is detectable by a label position sensor 33 which detects positioning marks 4 on the labels or on the backing sheet while the labels are fed over a printing region between a thermal print head 34 and a platen 35 in the printing section 15.

After being imprinted with information in the printing section 15, the labels 3 arrive at the redirecting member section 16 where, depending on how the label strip 1 has been loaded in the redirecting member section 16, the labels 3 are either peeled off the backing sheet 2 and removed one at a time therefrom, or are rolled up with the backing sheet 2 onto the take-up section 13. The operator of the printer 10 can select either of the aforementioned options.

More specifically, where the option to peel labels has been selected, only the backing sheet 2 is redirected by means of a redirecting pin 36. The labels 3 are, on the other hand, peeled off and held by a label holder 37. In the other option, the label strip 1, with the labels 3 thereon, is guided above the label holder 37 for being rolled up on a take-up core 38 of the take-up section 13. Note that the label holder 37 is releasable and rotatable as shown in phantom lines in FIG. 1, simplifying the insertion and feeding of the backing sheet. The label removal sensor 39 which is disposed near the redirecting member section 16 serves to sense that a label 3 has been removed from the label strip and to transmit a detection signal indicative thereof. This signal, in turn, causes printing of the next label 3 to begin.

The printing section 15 also includes an engaging-/releasing mechanism 40 and a printing pressure switch mechanism 41. The engaging/releasing mechanism 40 controls the position of the print head 34 relative to the platen 35, allowing the print head 34 to be disengaged to enable a label strip 1 to be loaded into the printing section 15. A switch in the printing pressure switch mechanism 41 allows an operator to adjust the contact pressure between the thermal print head 34 and the platen 35 to accommodate the different pressure requirements of tags and labels.

The platen 35 is driven by a feed drive motor 42 through the timing belt 43. The motor 42 also drives the take-up core 38 since the latter is linked by a round belt 44 to the platen 35.

The engaging/releasing mechanism 40 and the printing pressure switch mechanism 41 are shown in more detail in FIGS. 2 and 3. Referring presently to FIGS. 1 and 3, it will be noted that the printing pressure switch mechanism 41 has a drive shaft 50 and a pressing member 51. The drive shaft 50 is movable within an arc-shaped guide channel 55 formed by a pair of support frames 54 (FIG. 2). The drive shaft 50 is linked to a switch operating lever 53 through a rotating member 52 and can be set, by means of the lever 53, at either the position P1 or P2, the positions P1 and P2 being located at the opposite, distal ends of the guide channel 55.

The pressing member 51 is rotatable about the drive shaft 50 and comprises two, telescopically coupled and relatively movable, pieces including a drive-side spring holder 56 and a press-side spring holder 57. A spring 58 which is mounted between the spring holders 56 and 57 tends to force the holders 56 and 57 apart.

Specifically, one end of the drive-side spring holder 56 is connected to the drive shaft 50 and has an internal central post 59 which is freely movable within a centered sheath 60, defined within the spring holder 57. The force of the spring 58 serves to press the tip 61 of the press-side spring holder 57 elastically against a member 64 of a support member 62 of the thermal print head 34.

Note that the distance D1 from the tip 61 to the first position P1 is shorter than the distance D2 to the second position P2. Consequently, at the P1 position, the spring 58 will be more compressed, causing the tip 61 to exert a greater force on the print head pressing member 64 and thus on the print head 34.

The support member 62 is comprised of a print head attachment member 63 and a print head pressing member 64. Attachment member 63 has attached to it, on the side thereof which faces the platen 35, the thermal print head 34 and is itself rotatably supported on the fixed spindle 65. The spindle 65 passes through an oval-shaped, loosely-fitting channel 66 in the attachment member 63 and spans the pair of support frames 54. Inside the loosely-fitting channel 66, an inwardly protruding ring 67 (FIG. 2) defines a narrow, oval-shaped through hole 68, the hole 68 being disposed in the center of the channel 66 or, in other words, midway along the length of the print head attachment member 63.

The loosely-fitting channel 66 is widest at its distal ends and it tapers radially inward from the opposite distal ends of the channel 66 towards the inwardly protruding ring 67, positioned midway in the channel 66. Therefore, the print head attachment member 63 is able to pivot in the lengthwise direction with respect to the platen 35, with the protruding ring 67 serving as the fulcrum (see arrow A in FIG. 2) for the pivoting motion of the member 63. In other words, the ring 67 serves as a pivot for the print head attachment member 63 and, therefore, to the thermal print head 34 which is fixed to the member 63. The structure described above acts, so to speak, as a means which enables the print head 34 to equalize and control the pressure applied on the labels 3 being imprinted.

The ability of the thermal head 34 to pivot as described above allows it to respond to any variations in contact pressure which might develop along the width direction of the label strip 1. The print head 34 is able correct its position to make the printing pressure along the width of labels uniform.

A linking section 69 links the print head attachment member 63 to the print head pressing member 64 and enables the members 63 and 64 to rotate as a unit around the fixed spindle 65, as indicated by the arrow B in FIGS. 1 and 3.

A roller 71 which can be brought in and out of contact with the label strip 1 is linked to the lower end of the print head pressing member 64 by a link mechanism 70. The contact roller 71 is positioned on the tip of an arm which rotates around a fixed axle 72, this rotation being interlinked with the rotation of the pressing member 63 about its own spindle 65.

On the back side of the print head pressing member 64, an engaging/releasing drive member 73 serves to release/engage the thermal print head 34 from the platen 35 as desired, the engaging/releasing drive member 73 being operated by a lever 74 integrally connected thereto.

To first release and then engage the thermal print head 34 one proceeds by first rotating the lever 74 to the position shown by the double-dotted broken line in FIGS. 1 and 3. In this position, the drive member 73 pushes on the back side of the print head pressing member 64, causing the support member 62, or more specifically, the print head attachment member 63 and the print head pressing member 64 to rotate against the force of the spring 58, counterclockwise in FIG. 3. This separates the thermal print head 34 from the platen 35 and also serves to move the contact roller 71 to a position behind the passage 14 of the label strip 1, allowing obstruction free loading and feeding of the label strip 1.

After the label strip 1 has been properly loaded, the lever 74 is rotated counterclockwise to the position shown by the single-dotted broken line in FIGS. 1 and 3. This releases the pressure on the drive member 73 and allows the print head attachment member 63 and the print head pressing member 64 to be pushed toward the platen 35 by the force of the spring 58 of the printing pressure switch mechanism 41. The platen 35 and the thermal print head 34 will, as a result, contact one another at a specified pressure, or more precisely at the printing pressure.

For the purposes of printing tags rather than labels, the switch operating lever 53 is moved to the position shown by the double-dotted broken line in FIGS. 1 and 3. This will move the drive shaft 50 within the arc-shaped guide channel 55, to the position P1. The internal central post 59 of the drive-side spring holder 56 will then enter deeper into the sheath 60 of the press-side spring holder 57, compressing the spring 58 and thus increasing the force exerted on the tip 61 and, therefore, on the print head pressing member 64. Obviously, therefore, the printing pressure between the thermal print head 34 and the platen 35 will increase correspondingly to provide an appropriate, greater printing pressure necessary for tags since tags are stiffer than labels and have lesser friction with the thermal print head 34.

However, to print labels, the switch operating lever 53 would be moved to the position shown by the single-dotted broken line FIGS. 1 and 3. The drive shaft 50 will then be located at the second position P2, causing the internal central post 59 of the drive-side spring holder 56 to retreat from within the sheath 60. In this case, because the distance D2 from the tip 61 to the position P2 is larger, the pressing force developed by the drive-side spring holder section 56 is lower, reducing the printing pressure to that appropriate for imprinting information on label strips.

Regardless of the magnitude of the printing pressure, the print head attachment member 63 will retain its ability to pivot within a plane parallel to the axial direction of the platen 35, effectively equalizing the printing pressure and adjusting it to the conditions which depend on how the label strip or price tags are being fed into the printer.

The conditions which affect the printing pressure depend on various factors including the manner in which a label strip 1 is positioned relative to the platen 34, the precise location of the pivoting point of the attachment member 63, and also the width of the label strip 1. Many different designs may be employed to take these factors into account. Several such designs are described below by reference to FIGS. 4–9.

Figure 4:
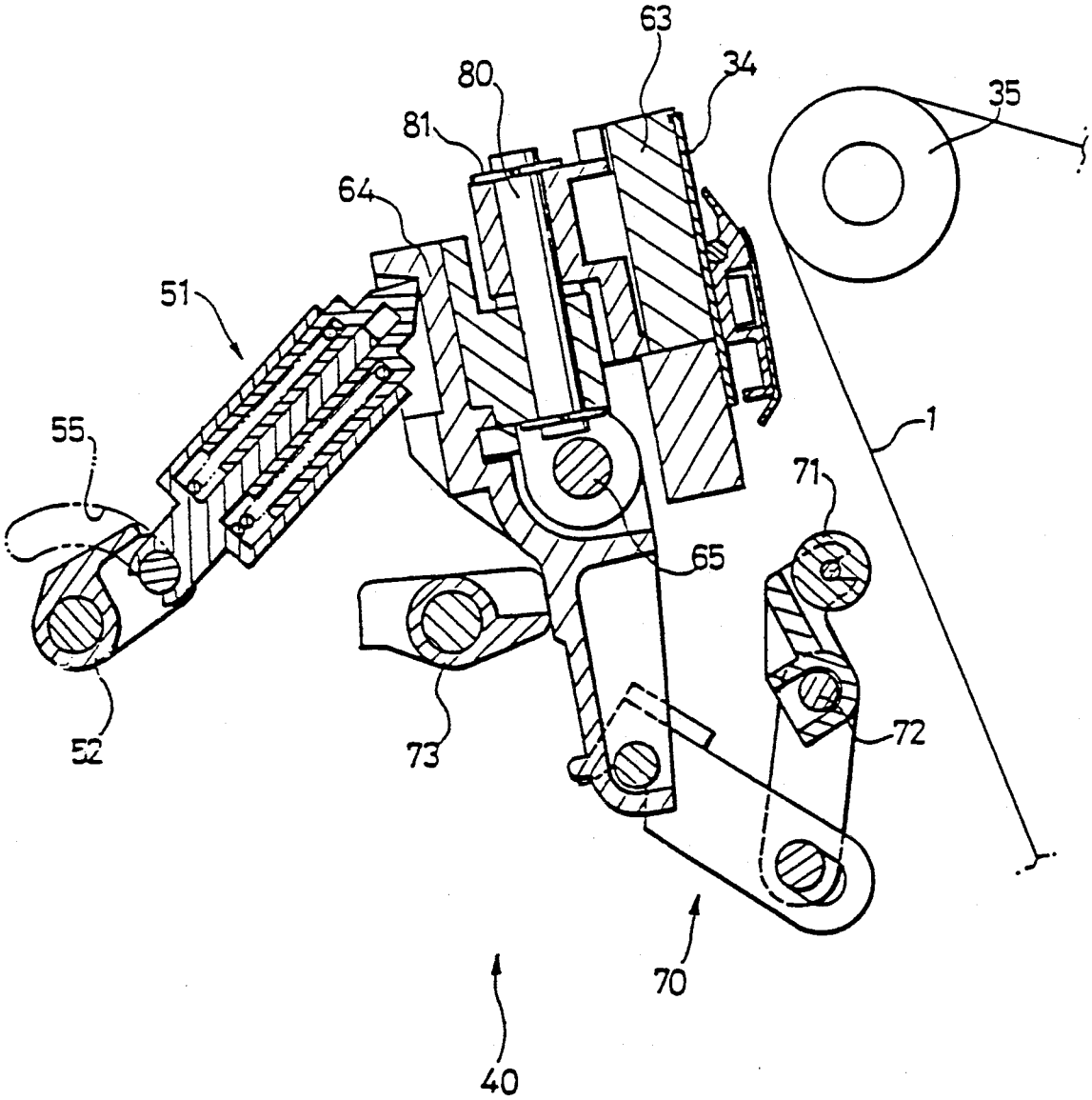
FIGS. 4 through 9 are section and plan views showing several different embodiments of a pivotable print head supporting member.
Figure 5:
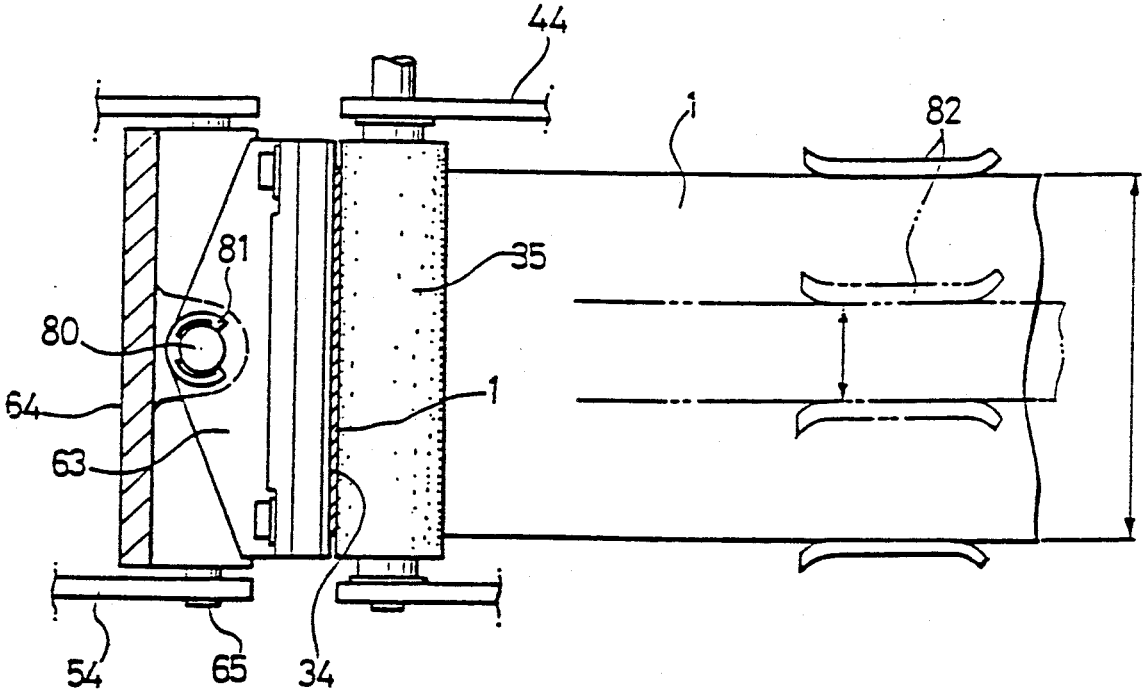

Thus, referring first to FIG. 4 and FIG. 5, it will be noted that the spindle 65 passes through a fitted, rather than a loose, opening in the pressing member 64. However, to allow the attachment member 63 to pivot relative to the axis of the platen 35, it is mounted, as shown in FIG. 4, to pivot about a support shaft 80 which shaft 80 is attached by means of washers 81 to both the print head pressing member 64 and the print head attachment member 63. In this embodiment, only the attachment member 63 of the support structure 62 rotates about the shaft 80 to maintain the correct pressure.

As is true of the ring 67 in the preferred embodiment (FIG. 2), the support shaft 80 is located (FIG. 5) so that it is aligned with the center, halfway along the width dimension, of the label strip 1. By further guiding the label strip 1 by means of a label guide mechanism 82 which serves to center the strip 1 will be centered relative to the platen 35 regardless of its actual size, the printing pressure applied to the label strip 1 will be equalized both to the left and to the right of the center thereof. Note that the guide mechanism 82 corresponds to the label width control member 32 shown in FIG. 1. By centering the shaft 80 relative to the platen 35 and by constructing the pair of width control members 32 to move together (as shown in phantom lines in FIG. 5), both narrow and wide label strips 1 will always be centered relative to the shaft 80. This assures that the print head 34 will freely pivot about the center of the strip 1 allowing the printing pressure to be uniform across the entire strip.

Figure 6:
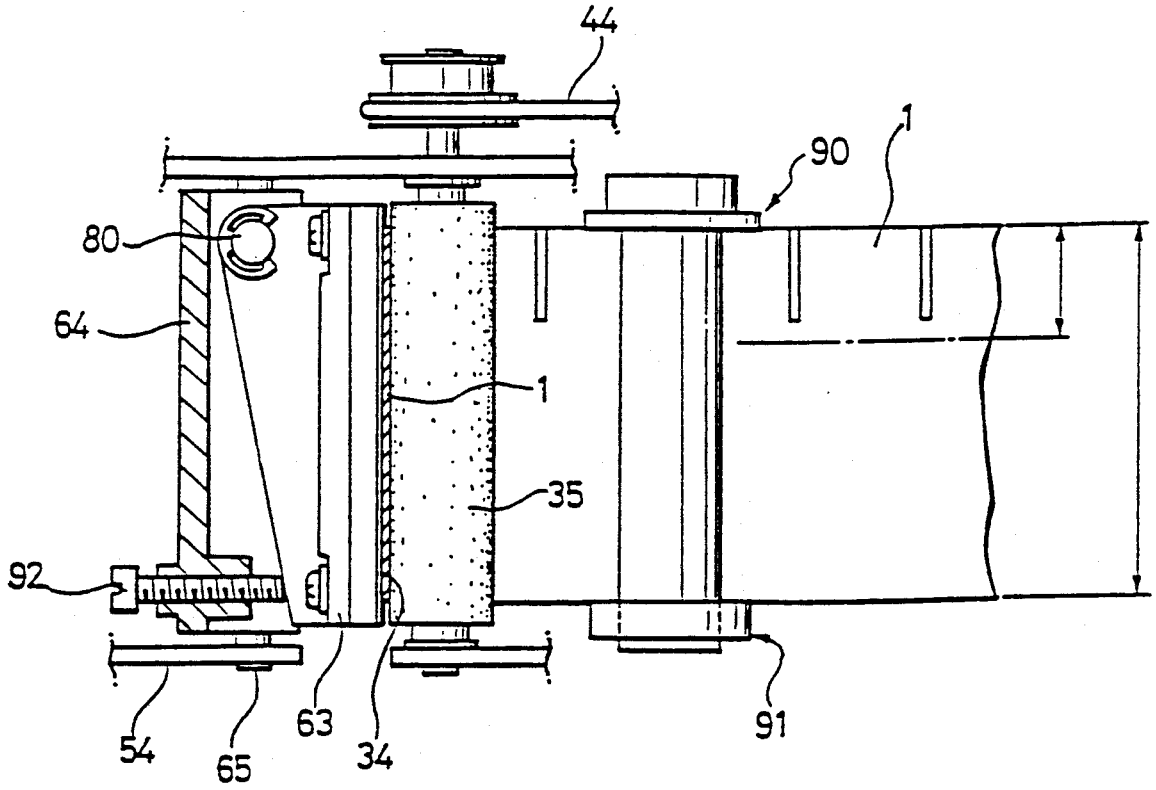

FIG. 6 illustrates a different label strip guiding mechanism comprising a fixed label guiding surface 90 and a movable guiding surface 91, which do not allow for centering the label strip 1 because, as shown in FIG. 6, both wide and narrow label strips 1 will have one side thereof in contact with the fixed surface 90. Consequently, the support shaft 80 in this embodiment has been placed at a position where its axis is slightly displaced along the width from the location of the fixed surface 90, near one end of the attachment member 63. An adjusting screw 92 is provided to contact the other end of the print head attachment member 63 to limit the degree of pivoting of the print head attachment member 63. By adjusting the screw 92, it is possible to control the parallelism between the platen 35 and thermal print head 34. In other respects, the embodiment of FIG. 6 is identical to that of FIG. 5.

The embodiment of FIG. 6 allows the printing pressure to be adjusted for wide and narrow label strips, despite the fact that the label strip 1 is not centered relative to the print head 34. The advantage of this embodiment is that it dispenses with the need for a more complicated label guiding structure or for a special label roll holder, etc., for centering the label strip 1 evenly about the center of the platen 35. This simplifies both the required hardware as well as the loading of the label strip 1.

Figure 7:
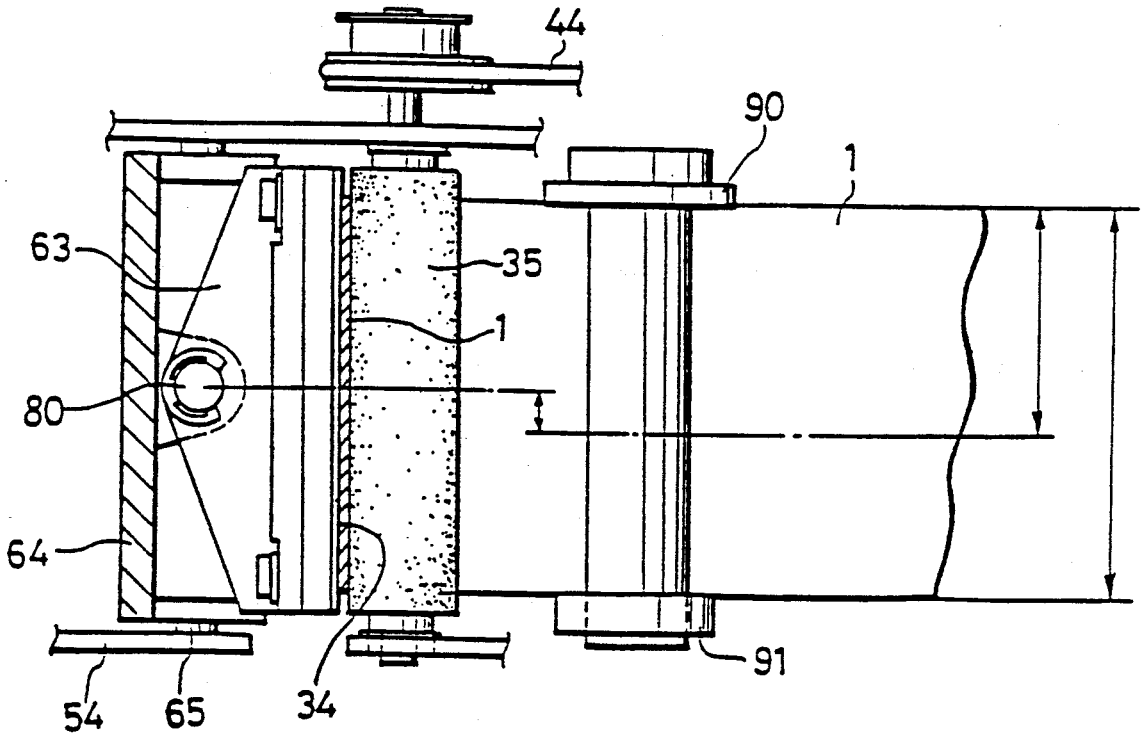

FIG. 7 combines the pivoting support shaft 80 of FIG. 5 with the structurally more simple label strip guiding structure (elements 90 and 91) of FIG. 6, but eliminates the adjusting screw 92 of FIG. 6. With this structure, the print head attachment member 63 is able to pivot about the shaft 80 to automatically adjust the printing pressure, as in the embodiment of FIG. 5. However, this embodiment works best with a label strip 1 which is at least as large as half of the platen 35, since otherwise the entirety of the label strip 1 will be disposed to one side of the shaft 80, making balancing of the print head 34 difficult. While the embodiment of FIG. 7 limits the width range of label strips, its structure, compared to FIG. 6, is simpler.

Figure 8:
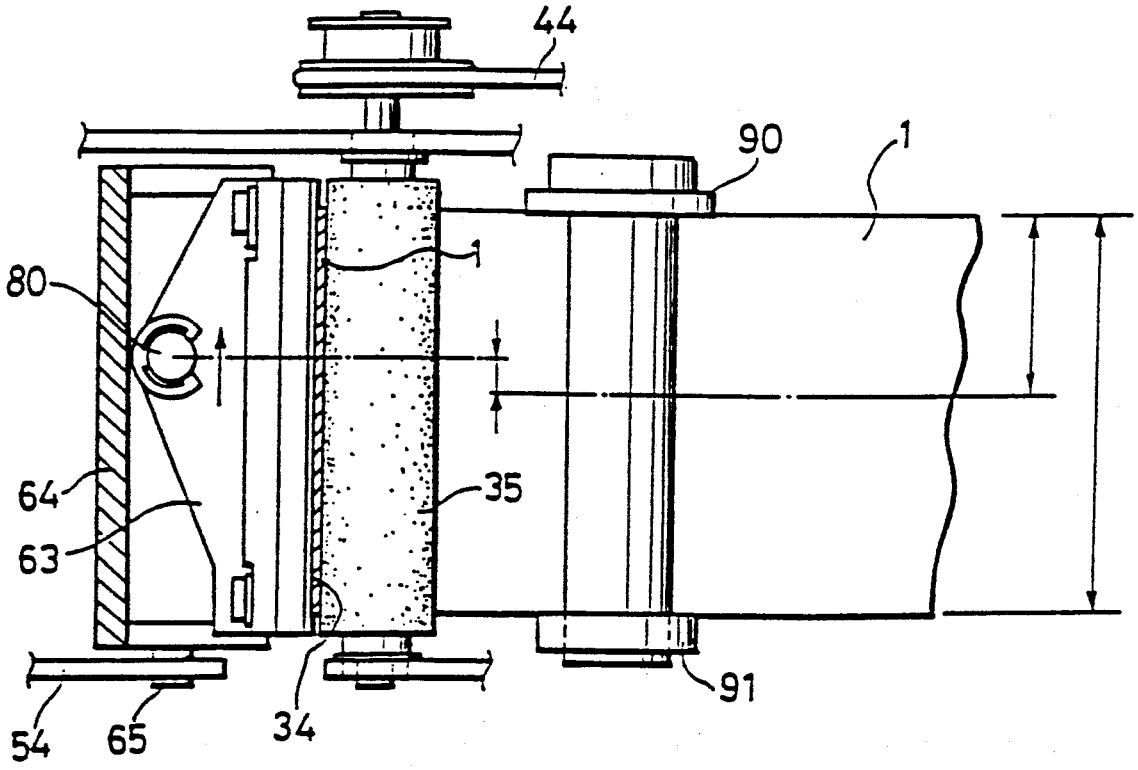

FIG. 8 is a variation on FIG. 7 in which the pivoting support shaft 80 has been located a bit closer to the fixed base surface 90, slightly off the centerline of the platen 35. This embodiment is capable of handling label strips 1 which are narrower than those in the embodiment of FIG. 7, increasing the range of usable label strip widths.

Figure 9:
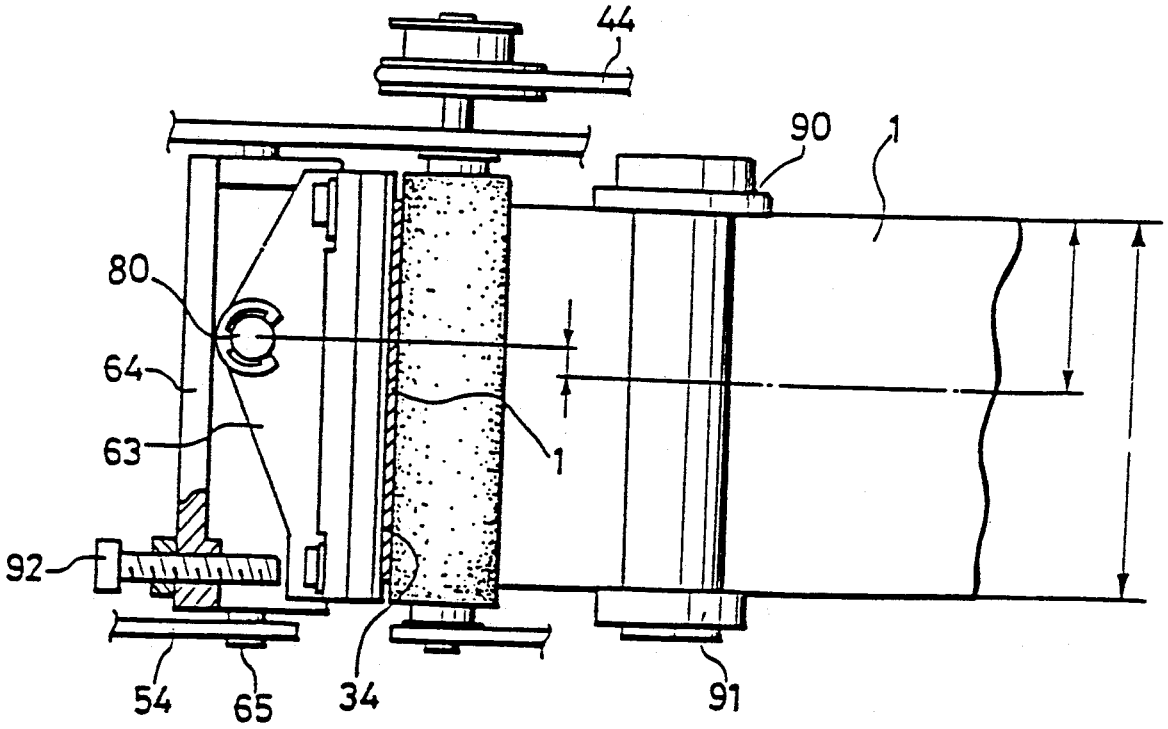
Figure 10:
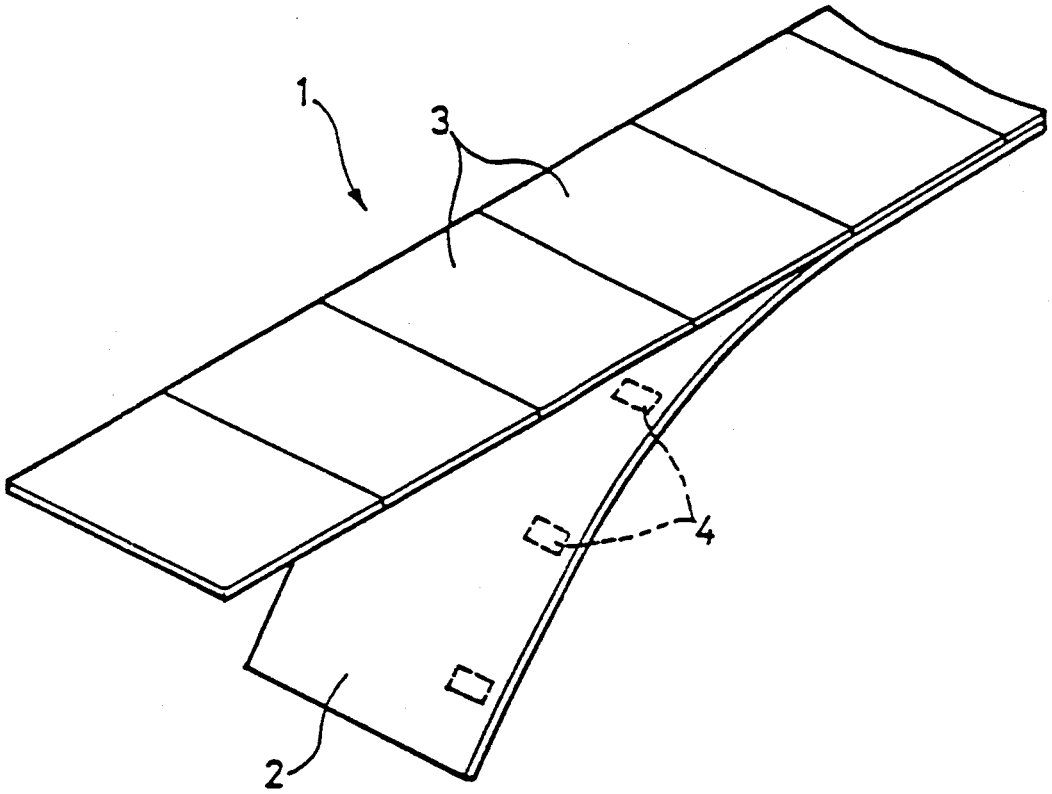
FIG. 10 is a perspective of a conventional label strip 1.

The structure of FIG. 9 adds to the embodiment of FIG. 8 the adjusting screw 92 of FIG. 6 and permits adjusting of the printing pressure for printing tags or the like which are particularly stiff.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A thermal printer, comprising:

a platen;

a thermal print head juxtaposed to the platen;

a printing region defined between the print head and the platen, the printing region being aligned with a width dimension of a medium to-be-printed by the print head; and printing pressure equalizing means for enabling the thermal print head to pivot in a predetermined plane and in a manner which results in the application to the medium-to-be-printed of a uniform printing pressure along substantially the entirety of the width dimension of the medium;

the pressure equalizing means comprising:

a support member for supporting the thermal print head, the support member including a print head attachment member to which the thermal print head is attached and a print head pressing member for enabling pressing of the print head attachment member and the thermal print head in a direction toward the platen;

a fixed spindle for rotatably supporting the support member thereon; and a pivot member between the support member and the fixed spindle for pivotably supporting the print head attachment member in such a way that it is able to pivot about the pivot member within the predetermined plane.

2. The thermal print head of claim 1, wherein the predetermined plane extends parallel to an axis associated with the platen.

3. The thermal printer of claim 2, further comprising means for adjusting the force developed by the print head pressing member.

4. The thermal printer of claim 1, further comprising centering means for centering the medium to-be-printed relative to the platen.

5. The thermal printer of claim 1, further comprising print head disengaging means for enabling the support member to be selectively engaged or disengaged from the platen.

6. The thermal printer of claim 5, further comprising a contact roller for bearing against the medium to-be-printed.

7. The thermal printer of claim 6, further comprising linking means for linking the contact roller with the disengaging means.

8. The thermal printer of claim 1, wherein the medium to-be-printed comprises a strip of labels.

9. The thermal printer of claim 1, wherein the medium to-be-printed comprises price tags.

10. A thermal printer, comprising:

a platen;

a thermal print head juxtaposed to the platen;

a printing region defined between the print head and the platen, the printing region being aligned with a width dimension of a medium to-be-printed by the print head;

printing pressure equalizing means for enabling the thermal print head to pivot in a predetermined plane and in a manner which results in the application to the medium to-be-printed of a uniform printing pressure along substantially the entirety of the width dimension of the medium; and force adjusting means for adjusting the force developed by the printing pressure equalizing means, the force adjusting means comprising a pair of telescopically coupled and relatively moveable spring holders including a first spring holder and a second spring holder, a spring disposed between the first and second spring holders in a manner tending to force the holders apart, the second spring holder bearing against the support member and being effective to force the same toward the platen.

11. The thermal printer of claim 10, further comprising a pivoting mechanism for the force adjusting means, the first spring holder being pivotably connected to the pivoting mechanism and the pivoting mechanism being effective to pivot the force adjusting means between first and second positions in which the force adjusting means applies, respectively, first and second forces to the support member.

12. The thermal printer of claim 11, the pivoting mechanism comprising a layer, the first spring holder being pivotably connected to the lever and the lever being pivotable between respective first and second positions thereof.

13. The thermal printer of claim 11, further comprising an arcuate channel, the first spring holder having a portion movable between first and second distal ends in the arcuate channel.

14. A thermal printer, comprising:

a platen;

a thermal print head juxtaposed to the platen;

a print region defined between the print head and the platen, the printing region being aligned with a width dimension of a medium to-be-printed by the print head; and printing pressure equalizing means for enabling the thermal print head to pivot in a predetermined plane and in a manner which results in the application to the medium to-be-printed of a uniform printing pressure along substantially the entirety of the width dimension of the medium;

the printing pressure equalizing means comprising:

a support member for supporting the thermal print head;

means for pressing the support member and the thermal print head attached thereto in a direction toward the platen, a loosely-fitting channel defined in the support member;

a fixed spindle for rotatably supporting the support member thereon, the fixed spindle passing through the loosely-fitting channel; and a pivot member between the support member and the fixed spindle for pivotably supporting the support member in such a way that it is able to pivot about the pivot member, within the predetermined plane.

15. The thermal printer of claim 14, wherein the pivot member comprises a ring which is positioned about midway relative to the printing region.

16. The thermal printer of claim 14, wherein the support member comprises an attachment member to which the thermal print head is attached and a print head pressing member for enabling pressing of the print head attachment member and the thermal print head in the direction toward the platen.

17. The thermal printer of claim 16, wherein the channel passes through the print head attachment member.

18. A thermal printer, comprising:

a platen;

a thermal print head juxtaposed to the platen;

a printing region defined between the print head and the platen, the printing region being aligned with a width dimension of a medium to-be-printed by the print head; and printed pressure equalizing means for enabling the thermal print head to pivot in a predetermined plane and in a manner which results in the application to the medium to-be-printed of a uniform printing pressure along substantially the entirety of the width dimension of the medium;

the pressure equalizing means comprising:

a support member for supporting the thermal print head, the support member including a print head attachment member to which the thermal print head is attached and a print head pressing member for enabling pressing of the print head attachment member and the thermal print head in a direction toward the platen;

a first spindle for rotatably supporting the support member thereon, the first spindle passing through the print head pressing member;

a second spindle passing through the printer attachment member and the print head pressing member, the print head attachment member being pivotable about the second fixed spindle in a manner enabling the print head attachment member to pivot in the predetermined plane.

19. The thermal printer of claim 18, wherein the second fixed spindle is centered relative to the printing region.

20. The thermal printer of claim 18, wherein the second spindle is located more toward a first end of the printing region.

21. The thermal printer of claim 20, further comprising an adjusting screw disposed to bear on the print head attachment member at a location thereof which is located oppositely, along the printing region, to the first end of the printing region.

22. The thermal printer of claim 21, further comprising means for guiding the medium to-be-printed and wherein the means for guiding the medium to-be-printed lacks a capability to center the medium to-be-printed relative to the printing region.

* * * * *